US008852724B2

(12) United States Patent
Calmes

(10) Patent No.: US 8,852,724 B2
(45) Date of Patent: Oct. 7, 2014

(54) BRIDGE MEMBER SPANNING FORMLINER JOINT

(75) Inventor: Shane Calmes, Onalaska, WI (US)

(73) Assignee: Advanced Formliners, LLC, Onalaska, WI (US)

( * ) Notice: Subject to any disclaimer, the term of this patent is extended or adjusted under 35 U.S.C. 154(b) by 300 days.

(21) Appl. No.: 13/220,496

(22) Filed: Aug. 29, 2011

(65) Prior Publication Data

US 2012/0074604 A1 Mar. 29, 2012

(51) Int. Cl.

| | |
|---|---|
| ***E04G 17/00*** | (2006.01) |
| ***E04G 9/10*** | (2006.01) |
| ***B28B 7/00*** | (2006.01) |

(52) U.S. Cl.

CPC ..... *E04G 9/10* (2013.01); *E04G 17/005* (2013.01); *B28B 7/0073* (2013.01)

USPC ..... 428/178; 249/16; 428/180

(58) Field of Classification Search

CPC ... E04F 13/0862; E04F 13/0873; E04F 13/09; E04C 1/40; E04G 9/10; E04G 17/005; B44F 5/00; B44F 9/04; B32B 3/28; B32B 3/30; B22D 19/04; B28B 7/0073

USPC ..... 249/15, 16, 96; 52/314, 316, 384, 385, 52/386, 387, 389; 428/174, 177, 180, 182

See application file for complete search history.

(56) References Cited

U.S. PATENT DOCUMENTS

| | | | | |
|---|---|---|---|---|
| 1,809,504 | A * | 6/1931 | Carvel | 52/745.11 |
| 2,465,871 | A | 3/1949 | Hardie et al. | |
| 3,349,158 | A | 10/1967 | Maynard | |
| 3,382,640 | A | 5/1968 | Thomas et al. | |
| 3,594,968 | A | 7/1971 | Johnson | |
| 3,602,476 | A | 8/1971 | Iragorri | |
| 3,908,326 | A * | 9/1975 | Francis | 52/384 |
| 4,239,824 | A | 12/1980 | Kasten | |
| 5,038,541 | A | 8/1991 | Gibbar, Jr. | |
| 5,268,137 | A | 12/1993 | Scott et al. | |
| 5,667,190 | A | 9/1997 | Scott et al. | |
| 5,701,710 | A | 12/1997 | Tremelling | |
| 5,787,667 | A | 8/1998 | Sheahan et al. | |
| 5,887,846 | A | 3/1999 | Hupp | |
| 5,900,180 | A | 5/1999 | Scott et al. | |
| 6,041,567 | A | 3/2000 | Passeno | |
| 6,059,257 | A | 5/2000 | Scott, III | |
| 6,164,037 | A | 12/2000 | Passeno | |
| 6,408,585 | B1 * | 6/2002 | Tajima | 52/506.06 |
| D479,614 | S | 9/2003 | Scott et al. | |
| 6,857,248 | B2 | 2/2005 | Ouellet et al. | |
| 7,658,050 | B2 | 2/2010 | Bouchard et al. | |
| 7,963,499 | B2 | 6/2011 | Fitzgerald et al. | |
| 2002/0106504 | A1 | 8/2002 | Stott | |
| 2005/0064128 | A1 | 3/2005 | Lane et al. | |
| 2005/0097827 | A1 | 5/2005 | Jordan | |

(Continued)

*Primary Examiner* — Michael Safavi

(74) *Attorney, Agent, or Firm* — Vidas, Arrett & Steinkraus

(57) ABSTRACT

A form liner system comprises a first form liner, a second form liner and a bridge member. Each form liner comprises a plurality of raised portions defining a plurality of cells and at least one partial cell. The form liners are arranged such that the partial cells form a collective cell. The bridge member can be oriented in said collective cell, wherein a first portion of the bridge member is oriented in the first liner partial cell and a second portion of the bridge member is oriented in the second liner partial cell.

20 Claims, 6 Drawing Sheets

(56) References Cited

U.S. PATENT DOCUMENTS

| | | | | |
|---|---|---|---|---|
| 2006/0091282 | A1* | 5/2006 | Walters | 249/16 |
| 2006/0157634 | A1 | 7/2006 | Nasvik | |
| 2006/0180731 | A1 | 8/2006 | Scott et al. | |
| 2007/0209308 | A1 | 9/2007 | Barrett | |
| 2007/0217865 | A1 | 9/2007 | Castonguay et al. | |
| 2009/0100774 | A1 | 4/2009 | Fasching et al. | |
| 2010/0314527 | A1 | 12/2010 | Fitzgerald et al. | |

* cited by examiner

BRIDGE MEMBER SPANNING FORMLINER JOINT

BACKGROUND OF THE INVENTION

This invention relates to a form liner system that allows for multiple form liners to be utilized while creating a product, such as a concrete wall, that appears to have been created using a single, continuous form liner.

In the last several decades, the concrete industry has been advantaged by using form liners as a method of imprinting textures into concrete walls. Concrete walls created using such form liners can include three-dimensional texturing and decorative patterns. Some concrete walls are able to simulate the look of a traditional masonry structure, such as brick and mortar, rock and mortar, etc.

To create a continuous wall that is larger than a given form liner, multiple form liner sheets are laid into a casting bed adjacent one another. In some instances, portions of the adjacent liners may overlap. Desirably, the individual liners are shaped and positioned such that any pattern formed in the liners will appear to be continuous across the multiple liners. Cementous material is then poured onto the liners. After the cement has cured, the form liners are removed, thereby exposing the texture in the concrete.

A problem that occurs in walls formed using multiple form liners is evidence of the discontinuous, multiple form liners. For example, adjacent form liners may not adequately seal against one another, allowing concrete slurry to migrate between, and even behind, the form liners. This results in an uneven wall, ridges in the wall, breaks in any patterns formed in the wall, etc. Unfortunately, these imperfections are created in the face of the resulting wall and are highly visible. Contractors often spend time performing cosmetic work to the resulting, cured wall to remedy such imperfections, such as grinding, patching and coloring.

Some contractors will apply caulk to joint areas between adjacent and/or overlapping form liners in an attempt to prevent a visible seam. Such caulking is somewhat labor intensive and can produce intermittent results.

Another problem with prior art form liner systems stems from warping, buckling and/or bulging of the form liners. Any such shape change can create imperfections in the resulting wall. To combat such problems, contractors often secure the form liners to the casting bed, for example by screwing through the face of the form liner. Although such fasteners will hold the form liners in place, the fasteners themselves can distort the face of the resulting wall.

U.S. Pat. No. 7,963,499 teaches form liners that include raised sections that allow for interconnection of adjacent liners in a nested manner. Although the nested liners provide a benefit over non-nested liners, the nested liners can still allow a visible (e.g. raised) seam on the face of a wall at locations where the wall would desirably be flush and continuous.

There remains a need for a formliner system capable of using multiple form liners to create a wall that appears to have been made from a single, continuous form liner.

There remains a need for a formliner system capable of being secured using fasteners, wherein the resulting wall does not exhibit evidence of such fasteners.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a form liner system comprises a first form liner, a second form liner and at least one bridge member. The first form liner comprises a plurality of raised portions defining a plurality of cells. The raised portions fully surround at least one cell, and the first form liner comprises at least one first liner partial cell having an edge that is not defined by a raised portion. The second form liner is placed adjacent to said first form liner. The second form liner comprises at least one raised portion defining a second liner partial cell, wherein the second liner partial cell includes an edge that is not defined by a raised portion. The first liner partial cell and the second liner partial cell form a collective cell. The bridge member is oriented in the collective cell, wherein a first portion of the bridge member is oriented in the first liner partial cell and a second portion of the bridge member is oriented in the second liner partial cell.

In some embodiments, a method of forming a cured wall comprises providing a first form liner comprising a first partial cell and a second form liner comprising a second partial cell. The first and second form liners are oriented such that the first and second partial cells form a collective cell. A bridge member is provided and oriented in the collective cell. A curable material such as concrete can be poured onto the form liner system and cured to form a wall.

In some embodiments a form liner comprises a plastic sheet thermoformed into a particular form liner pattern. In some embodiments, a form liner further comprises texturing on its surfaces.

In some embodiments, multiple form liners are configured to overlap. In some embodiments, a portion of a first form liner is configured to overlap and mate with a portion of a second form liner.

In some embodiments, two form liner sheets are configured to butt against one another evenly.

In some embodiments, two form liners are configured to overlap one another.

In some embodiments, two form liners are configured to interlock.

In some embodiments, a bridge member comprises surface texturing.

In some embodiments, a bridge member comprises an adhesive.

In some embodiments, the patterns formed in form liners are repeating. In some embodiments, the patterns comprise molds to form cured objects that resemble traditional building materials such as bricks, blocks, tile and geometric shapes.

In some embodiments the patterns and textures are not uniform, for example recreating the look of a hand laid stone wall.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
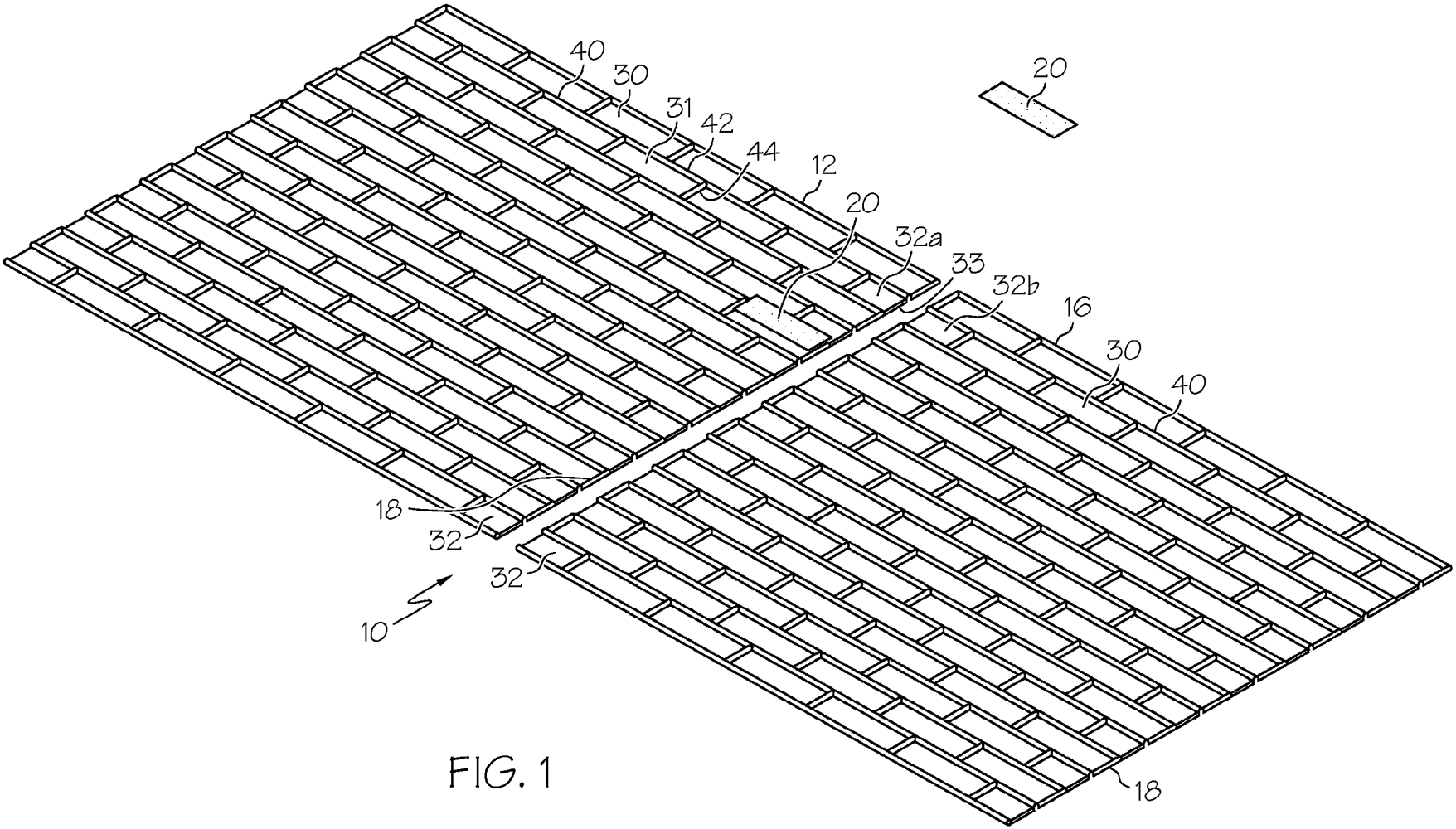
FIG. 1 shows an embodiment of a form liner system.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a form liner system 10 comprising a first form liner 12, a second form liner 16 and a bridge member 20.

In some embodiments, the bridge member 20 is arranged to span across the two form liners 12, 16, thereby creating a continuous surface spanning a portion of the connection/overlap/joint between the two form liners 12, 16.

A form liner (e.g. 12, 16) is desirably suitable to be used as formwork for creating a cured object, such as a concrete wall. For example, a form liner 12, 16 can be laid horizontally and concrete poured thereupon. After curing, the concrete wall can be separated from the form liner(s) 12, 16 and placed in a final position. In some embodiments, the form liners(s) 12, 16 can be arranged prior to the concrete pour such that the concrete wall cures in its final position. As such, a form liner 12, 16 comprises a mold, and any shapes and contours in the form liner 12, 16 will shape and contour a surface of the cured wall.

In some embodiments, a form liner 12, 16 can create a cured wall having decorative three dimensional patterns. In some embodiments, a resulting wall can have an appearance similar to traditional built-up walls, such as concrete, stone and or masonry walls. A form liner 12, 16 can have any suitable shape and any suitable pattern formed therein.

Figure 4:
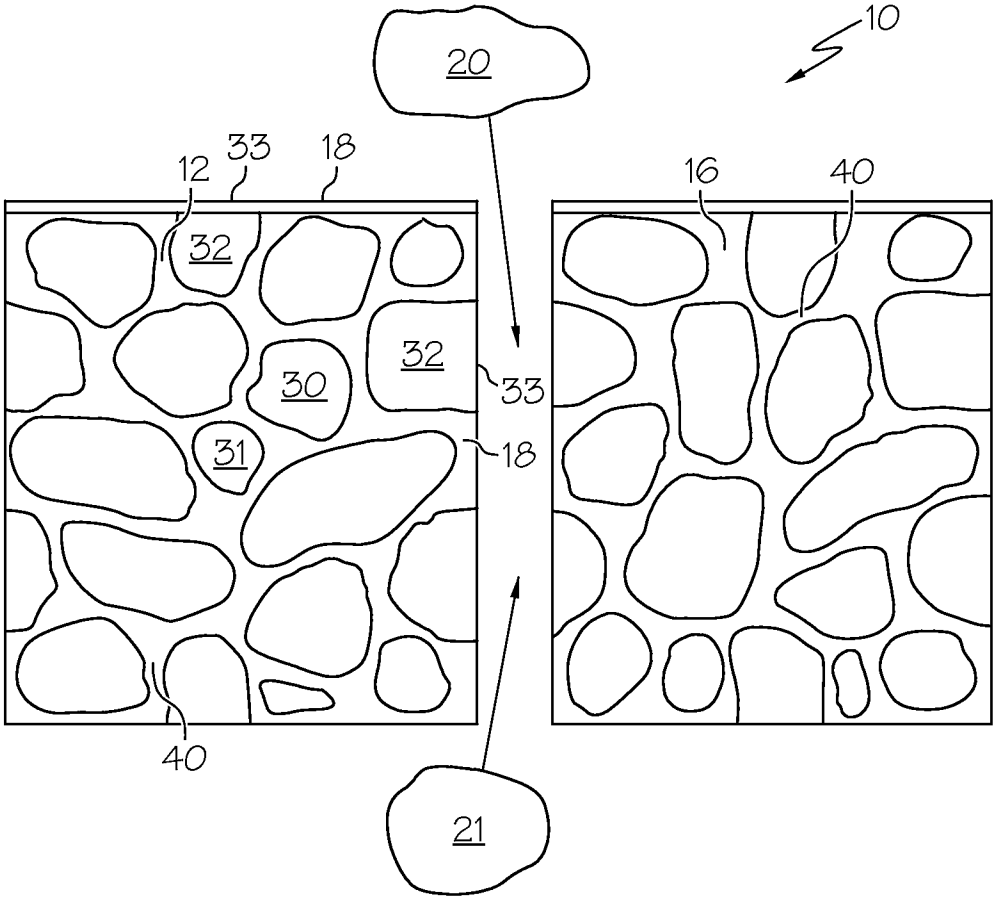
FIG. 4 shows another embodiment of a form liner system.

FIG. 1 shows form liners 12, 16 that are configured to create a cured wall that resembles traditional brick and mortar construction. FIG. 4 shows embodiments of form liners 12, 16 that are configured to create a cured wall that resembles a built-up stone wall.

In some embodiments, a form liner 12 comprises a plurality of cells 30. In some embodiments, a form liner 12 comprises a plurality of raised portions 40. Raised portion(s) 40 extend around and define cells 30. In some embodiments, a fully surrounded cell 31 is completely surrounded by raised portion(s) 40. In some embodiments, a partial cell 32 is partially surrounded by raised portion(s) 40. Desirably, a partial cell 32 includes at least one bounding portion 33, such as an edge, that is not defined by a raised portion 40.

A cell 30 can have any suitable shape and be of any suitable size. Raised portions 40 can also be of any suitable size and shape. FIG. 4 shows embodiments of form liners 12, 16 having cells 30 of various shapes and sizes, designed to resemble rocks or stone of varying shapes and sizes. The raised portions 40 extending between and defining the various cells 30 are of various sizes, shapes and widths.

Referring to FIG. 1, when the cells 30 are designed to resemble brick, the raised portions 40 can comprise row members 42 and column members 44 arranged in a repeating pattern. In some embodiments, a fully surrounded cell 31 is surrounded by two row members 42 and two column members 44.

In some embodiments, a form liner 12, 16 defines a plurality of cells 30 having a similar size and shape. In some embodiments, cells 30 of a similar shape are arranged in a repeating pattern.

In some embodiments, a first form liner 12 comprises cells 30 having a shape similar to cells 30 of a second form liner 16. In some embodiments, a first form liner 12 and a second form liner 16 have similar repeating cell patterns. In some embodiments, a first form liner 12 and a second form liner 16 are similar in size and shape. In some embodiments, the first form liner 12 and the second form liner 16 are substantially identical.

In some embodiments, a first form liner 12 comprises a partial cell 32 and a second form liner 12 comprises a partial cell 32. FIG. 1 shows an embodiment of first and second form liners 12, 16 oriented such that partial cells 32 of the first form liner 12 are adjacent to partial cells 32 of the second form liner 16.

Figure 2:
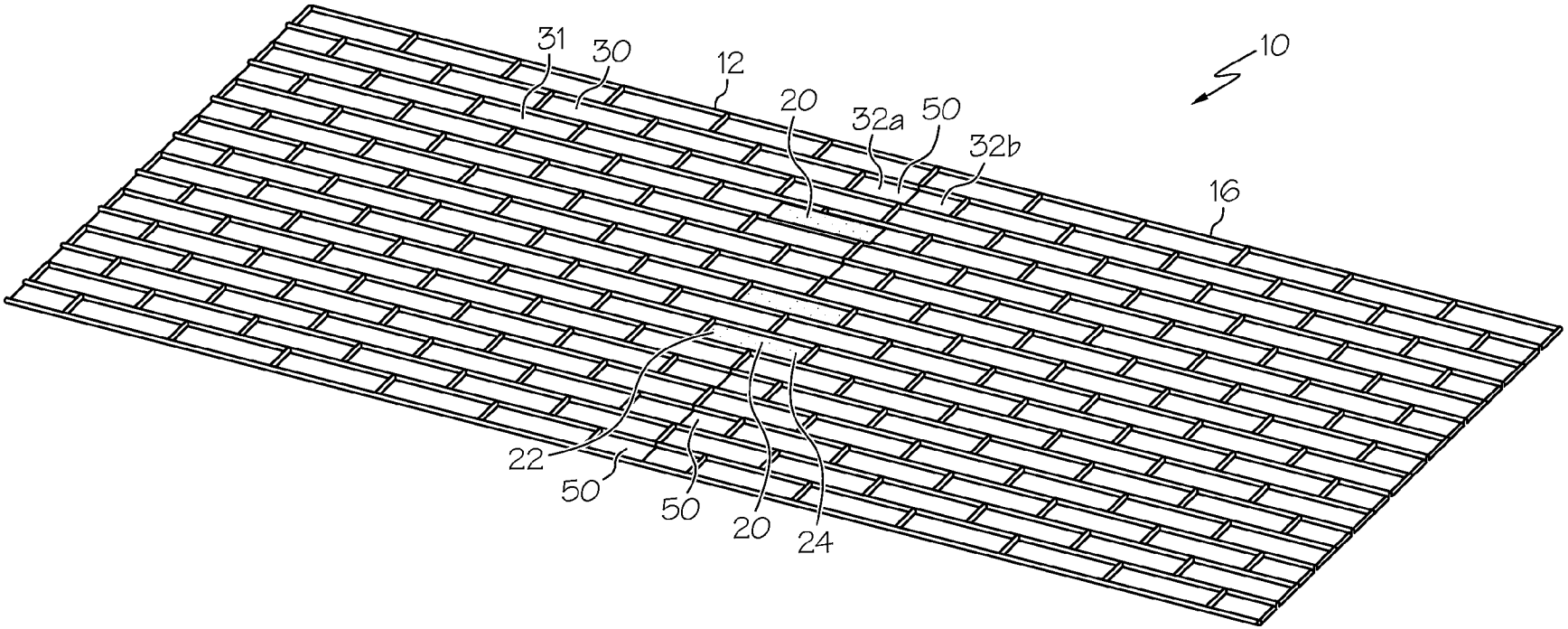
FIG. 2 shows another view of the form liner system of FIG. 1.

FIG. 2 shows the form liners 12, 16 of FIG. 1 placed closer together such that a first liner partial cell 32*a* and a second liner partial cell 32*b* combine to form a collective cell 50. Desirably, a collective cell 50 is a combination of partial cells 32 of at least two form liners 12, 16.

In some embodiments, a collective cell 50 is shaped similar to a fully surrounded cell 31 of at least one of the individual form liners 12, 16. In some embodiments, a collective cell 50 is shaped similar to fully surrounded cells 31 present in each of the individual form liners 12, 16.

In some embodiments, each fully defined cell 31 of the form liners 12, 16 comprises a similar shape, and a collective cell 50 also has the same shape. In some embodiments, a partial cell 32 is sized and shaped similar to one-half of a fully defined cell 31.

The form liner system 10 desirably comprises a bridge member 20, which can be placed in a collective cell 50 prior to pouring curable material (e.g. concrete) onto the form liners 12, 16. A first portion 22 of the bridge member 20 can be oriented in a first liner partial cell 32*a*, and a second portion 24 of the bridge member 20 can be oriented in a second liner partial cell 32*b*. In some embodiments, a bridge member 20 is substantially flat.

A bridge member 20 desirably minimizes any evidence that multiple form liners 12, 16 were used to form the resulting cured wall. For example, the form liners 12, 16 shown in FIG. 2 include several collective cells 50. If a resulting wall were made without using any bridge members 20, a person of ordinary skill in the art would expect a visible line to be formed in the resulting wall at each collective cell 50, for example where cured material took the shape of a seam formed between the two form liners 12, 16. When bridge members 20 are used in each collective cell 50, desirably the resulting wall has no evidence of multiple form liners 12, 16, and appears as if the wall were formed using a single, large form liner.

In some embodiments, the shape of a bridge member 20 is similar to the shape of a collective cell 50. In some embodiments, a perimeter of a bridge member 20 continuously abuts the raised portions 40 of the form liners 12, 16 that define a collective cell 50.

In some embodiments, the shape of a bridge member 20 is similar to a fully surrounded cell 31 of at least one form liner 12, 16. In some embodiments, the shape of a bridge member 20 is similar to that of fully surrounded cells 31 of each of the form liners 12, 16.

In some embodiments, a surface of a bridge member 20 comprises texturing. For example, a surface of a bridge member 20 that will contact curable material can comprise texturing to resemble the look of a building material. In some embodiments, a bridge member 20 is textured to resemble the face of a brick.

In some embodiments, form liners 12, 16 comprise texturing, for example to resemble various building materials. For example, the raised portions 40 can include texturing to resemble the appearance of mortar, while the cells 30, 31 can include texturing to resemble the appearance of brick. A form liner 12, 16 can include any suitable surface texturing.

In some embodiments, a bridge member 20 and a form liner 12 include similar surface texturing. In some embodiments, a texturing pattern included in a cell 30 is similar to a texturing pattern included on a bridge member 20. It is also possible for a form liner 12 and a bridge member 20 to have different texturing patterns.

In some embodiments, a bridge member 20 comprises an adhesive. In some embodiments, an entire surface of a bridge member 20 is coated with an adhesive. In some embodiments, a bridge member 20 comprises a first side having surface texturing and a second side having an adhesive. In some embodiments, a bridge member 20 can include a non-stick backing over an adhesive, which can be removed prior to placement of the bridge member 20 in a collective cell 50.

When a bridge member 20 comprises an adhesive, the adhesive can be used to secure the bridge member 20 to the form liners 12, 16. The adhesive can help to secure the form liners 12, 16 in place with respect to one another. The adhesive can also help to prevent curable material from migrating adjacent to or below the bridge member 20.

In some embodiments, a form liner 12 comprises at least one edge 18 having shaped portions 52 that are configured for overlap between adjacent form liners.

Figure 3:
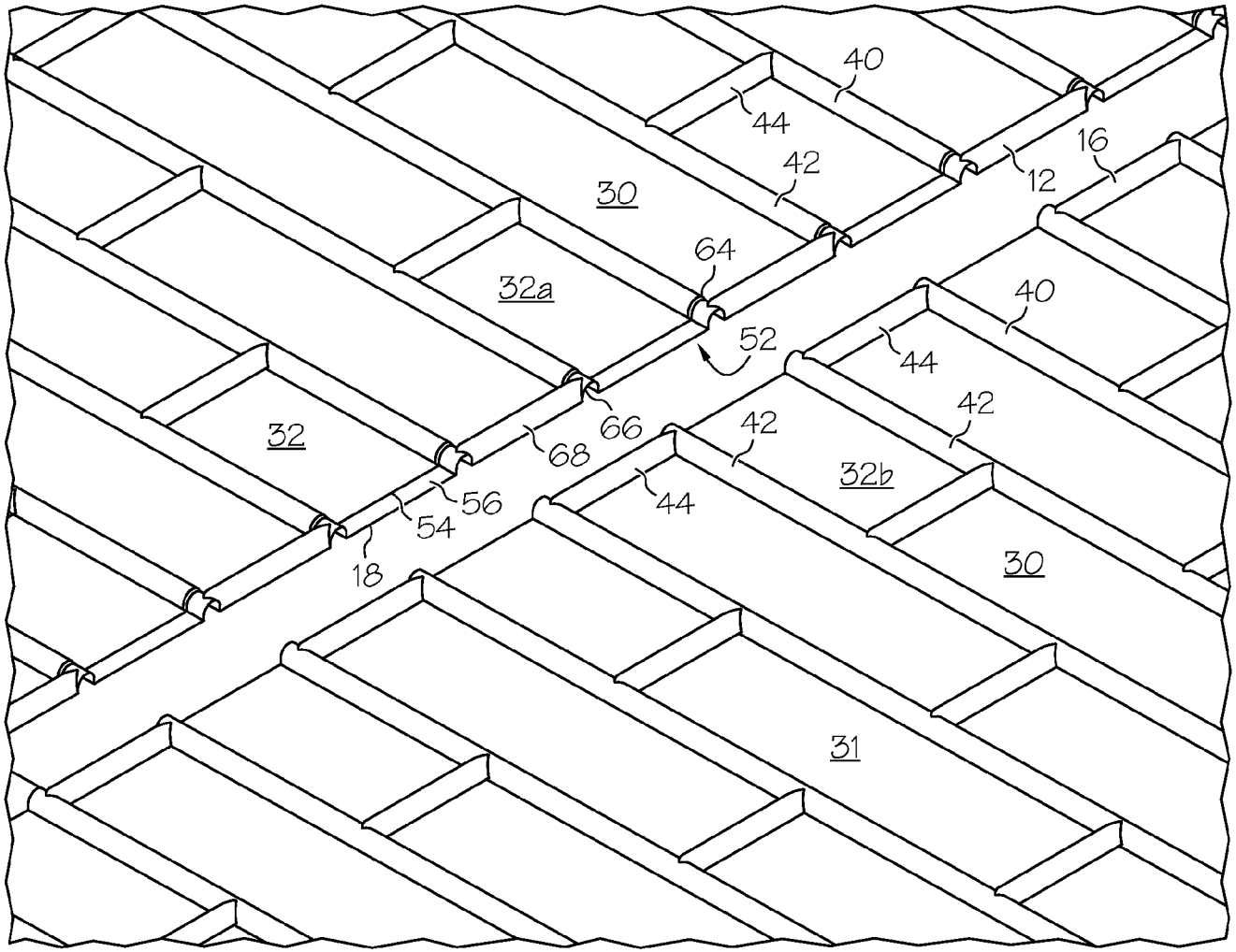
FIG. 3 shows a portion of FIG. 1 in greater detail.

FIG. 3 shows a portion of FIG. 1 in greater detail. In some embodiments, a form liner 12 comprises a jog 54 that forms a stepped portion 56 located near the edge 18 of the form liner 12. The lowered stepped portion 56 provides a floor for a second form liner 16 to rest upon. In some embodiments, a height of the jog 54 is approximately equal to a thickness of the form liner 12 at the partial cell 32. In some embodiments, a height of the jog 54 is approximately equal to a thickness of the second form liner 16 at a location that overlays the lowered stepped portion 56. Thus, when a first form liner 12 includes a first liner partial cell 32*a* having a jog 54 and stepped portion 56, a second form liner 16 can overlay the stepped portion 56, and the collective cell 50 resulting from the combination of the first liner partial cell 32*a* and a second liner partial cell 32*b* can have the partial cell portions 32*a*, 32*b* located at a similar height.

In some embodiments, a raised portion 40 of a second form liner 16 can overlap a first form liner 12. In some embodiments, a raised portion 40 of a second form liner 16 can overlap a raised portion of a first form liner 12.

In some embodiments, raised portions 40 located at an edge 18 of a form liner 12 are configured for overlap by raised portions of a second form liner 16. In some embodiments, a raised portion 40 comprises a jog 64 and a stepped down portion 66. For example, FIG. 3 shows a row member 42 of the first form liner 12 comprising a jog 64 and a stepped down portion 66 near the edge of the first form liner 12. The second form liner 16 comprises a row member 42 arranged to overlay the stepped down portion 66. For example, an upper surface (e.g. outer contour) of the stepped down portion 66 is sized to mate with an underside (e.g. inner contour) of the row member 42 of the second form liner 16.

In some embodiments, a column member 44 located along the edge 18 comprises a reduced size 68 when compared to other column members 44 of the first form liner 12. A column member 44 having a reduced size is desirably configured to mate with a normally sized column member 44 of a second form liner 16. For example, an upper surface (e.g. outer contour) of the reduced size 68 column member is sized to mate with an underside (e.g. inner contour) of the column member 44 of the second form liner 16.

FIG. 4 shows another embodiment of a form liner system 10 that comprises form liners 12, 16 and at least one bridge member 20. The embodiment of FIG. 4 comprises several cells 30 having different sizes and shapes.

In some embodiments, a form liner 12 comprises partial cells 32 having different shapes. Various partial cells 32 can be located on various sides of the form liner 12. The partial cells 32 of multiple form liners 12, 16 can form collective cells 50 having shapes that are different from one another. A form liner system 10 can have any suitable number of collective cells 50 of varying size and shape. A form liner system 10 having multiple collective cells 50 of different shape desirably comprises multiple bridge members 20, which can be shaped according to the multiple collective cells 50. Thus, a form liner system 10 can comprise a first bridge member 20 and a second bridge member 21 having a different shape.

In some embodiments, the cells 30 of a form liner 12 have a large three-dimensional shape. A partial cell 32 can similarly have a large three-dimensional shape, and a bridge member 20 that spans such partial cells 32 can also have a three-dimensional shape.

Figure 5:
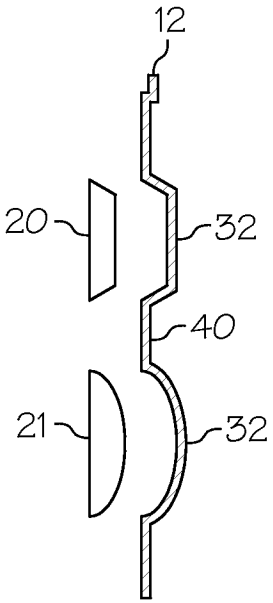
FIG. 5 shows the embodiment of FIG. 4 from an alternate viewing angle.

FIG. 5 shows a side view of a form liner 12 as shown in FIG. 4. The contours of the partial cells 32 are visible. The bridge members 20, 21 are shaped to properly sit in a portion of the partial cells 32, and are therefore shaped in three-dimensions. In some embodiments, a bridge member 20 comprises a convex or concave surface. In some embodiments, a first half of a bridge member 20 is asymmetrical when compared to a second half of the bridge member 20.

Figure 6:
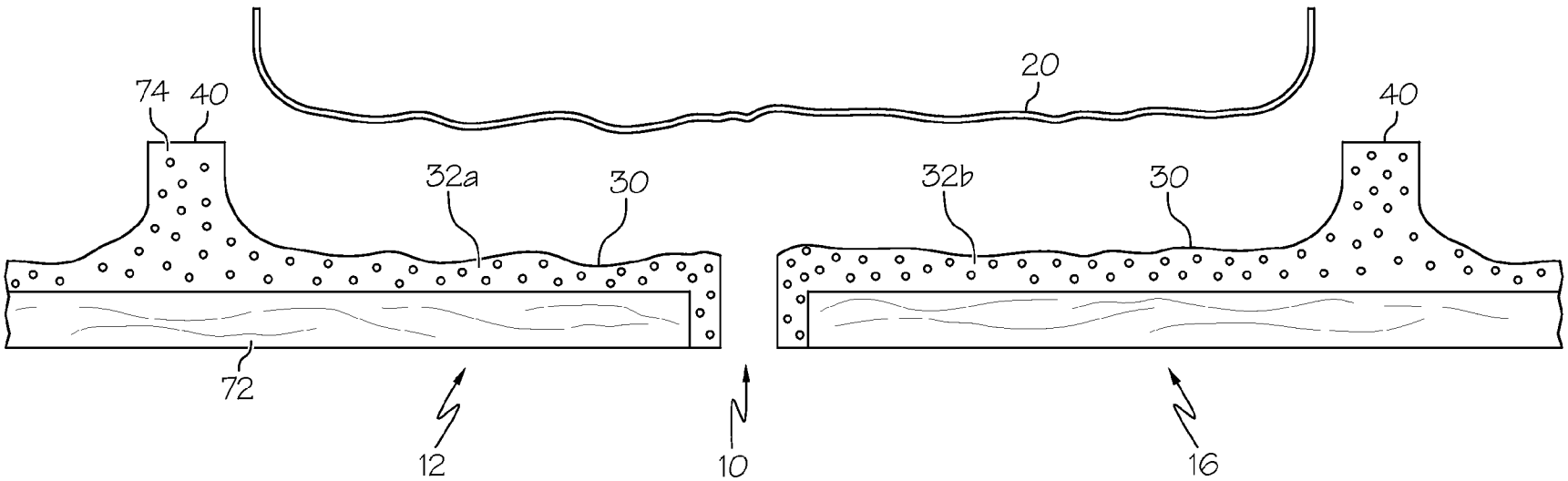
FIG. 6 shows another embodiment of a form liner system.

FIG. 6 shows another embodiment of a form liner system 10. In some embodiments, a form liner 12 comprises a first material 72 and a second material 74. In some embodiments, the first and second materials 72, 74 cooperate to provide the form liner 12 with properties that would not be available from either material 72, 74 individually. In some embodiments, the first material 72 is more rigid and the second material 74 is more flexible. Thus, the first material 72 can comprise a base layer, and the second material 74 can comprise an outer layer. As shown in FIG. 6, the first material 72 comprises a baseboard such as plywood, which provides strength and rigidity to the form liner 12. The second layer 74 comprises an outer layer that comprises raised portions 40 and defines cells 30, including partial cells 32.

In some embodiments, a second layer 74 is flexible and resilient, for example comprising an elastomer, rubber or the like. Desirably, after forming a cured object using the form liner 12, the flexibility and resiliency of the second layer 74 allows the form liner 12 to be removed from the cured object without substantially damaging the second layer 74. Thus, in some embodiments, a form liner 12 is capable of being used multiple times to form multiple cured objects.

In some embodiments, a pattern of raised portions 40 can be defined in the first material 72, and the second material 74 conforms to the contours of the first material 72.

Figure 7:
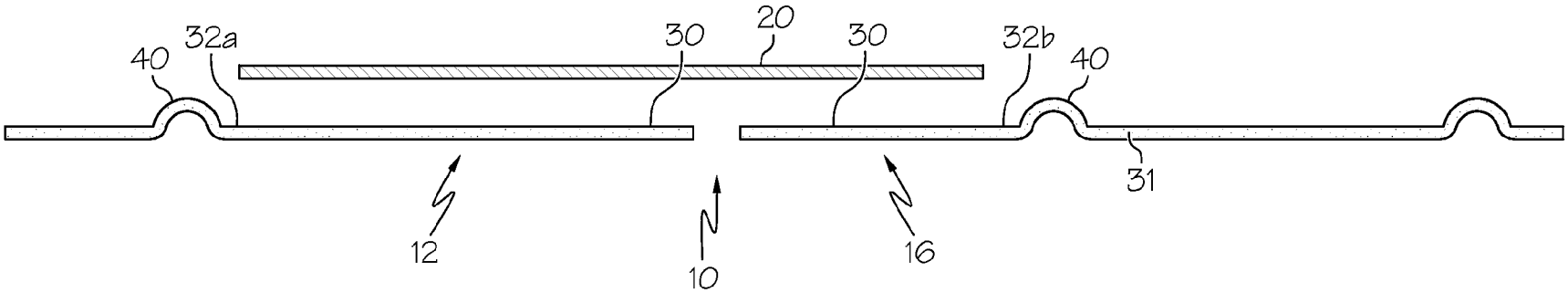
FIG. 7 shows another embodiment of a form liner system.

FIG. 7 shows another embodiment of a form liner system 10. The form liners 12, 16 each comprise a thin material that is rigid enough to retain its shape under the weight of the curable material used to form a cured object. In some embodiments, a form liner 12 comprises a thermoplastic.

The form liners 12, 16 are configured to be placed adjacent one another without overlap, thus forming a butt joint.

Although the form liners 12, 16 described herein are illustrated in the Figures as being oriented on a common plane (e.g. generally parallel to one another), in some embodiments, the form liner system 10 is configured to form an angle, such as a wall having a first portion disposed at an angle to a second portion. In some embodiments, the form liners 12, 16 are configured such that a first form liner 12 abuts or overlaps a second form liner 16, wherein the first form liner 12 is oriented in a first plane, and the second form liner is oriented in a second plane that is non-parallel to the first plane. In some embodiments, a collective cell 50 comprises a first partial cell 31 oriented at a non-zero angle to a second partial cell 31. In some embodiments, a bridge member 20 comprises a first portion oriented at an angle to a second portion. In some embodiments, a bridge member 20 comprises a first flat portion oriented at an angle to a second flat portion.

In various embodiments, form liners 12 can comprise any suitable material, such as thermoplastics (e.g. HIPS, PVC, polyolefins, ABS, thermoplastic elastomers, etc.), thermoplastic foams, elastomers (e.g. polyurethane rubber, silicone rubber, etc.), natural rubbers, fiber products (e.g. fiberglass, molded paper, etc.) and suitable combinations thereof.

In various embodiments, bridge members 20 can comprise any suitable material, such as the materials used to make the form liners 12. Bridge members 20 are not required to comprise the same material(s) as the form liners 12.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A form liner system comprising:

a first form liner comprising a plurality of raised portions defining a plurality of cells, said raised portions fully surrounding at least one cell, said first form liner comprising at least one first liner partial cell having an edge that is not defined by a raised portion;

a second form liner adjacent to said first form liner; said second form liner comprising at least one raised portion defining a second liner partial cell, said second liner partial cell having an edge that is not defined by a raised portion, said first liner partial cell and said second liner partial cell forming a collective cell; and a bridge member oriented in said collective cell, a first portion of said bridge member oriented in said first liner partial cell, a second portion of said bridge member oriented in said second liner partial cell, a thickness of said bridge member being less than a depth of said collective cell.

2. The form liner system of claim 1, wherein a shape of said bridge member is similar to a shape of said collective cell.

3. The form liner system of claim 1, wherein a perimeter of said bridge member continuously abuts the raised portions of the first form liner and second form liner that define said collective cell.

4. The form liner system of claim 1, wherein a shape of said bridge member is similar to a shape of a cell of said first form liner.

5. The form liner system of claim 4, wherein a shape of said bridge member is similar to a shape of a cell of said second form liner.

6. The form liner system of claim 1, wherein said bridge member comprises an adhesive.

7. The form liner system of claim 1, wherein a surface of said bridge member comprises surface texturing.

8. The form liner system of claim 7, wherein a cell of said first form liner comprises surface texturing.

9. The form liner system of claim 8, wherein the surface texturing of said bridge member matches the surface texturing of said cell of said first form liner.

10. The form liner system of claim 1, said first liner partial cell comprising a jog located near said edge, wherein a portion of said first form liner located between said jog and said edge comprises a stepped-down portion.

11. The form liner system of claim 10, wherein a portion of said second form liner overlaps said stepped-down portion.

12. The form liner system of claim 10, wherein a height of said jog is substantially equal to a thickness of a portion of said second form liner defining said second liner partial cell.

13. The form liner system of claim 1, further comprising a second bridge member, said first form liner comprising a second first liner partial cell, said second form liner comprising a second liner partial cell, said second first liner partial cell and said second liner partial cell forming a second collective cell, said second bridge member oriented in said second collective cell.

14. The form liner system of claim 13, wherein said bridge member and said second bridge member have the same shape.

15. The form liner system of claim 13, wherein said bridge member and said second bridge member comprise different shapes.

16. The form liner system of claim 13, wherein said collective cell and said second collective cell have different shapes.

17. The form liner system of claim 1, wherein said bridge member is concave.

18. A form liner system comprising:

a first form liner comprising a plurality of raised portions defining a plurality of cells, said raised portions fully surrounding at least one cell, said first form liner comprising at least one first liner partial cell having an edge that is not defined by a raised portion;

a second form liner adjacent to said first form liner; said second form liner comprising at least one raised portion defining a second liner partial cell, said second liner partial cell having an edge that is not defined by a raised portion, said first liner partial cell and said second liner partial cell forming a collective cell; and a bridge member oriented in said collective cell, a first portion of said bridge member oriented in said first liner partial cell, a second portion of said bridge member oriented in said second liner partial cell, a shape of said bridge member being similar to a shape of said collective cell;

wherein a surface of said bridge member, a surface of a cell of said first form liner and a surface of a cell of said second form liner each comprise similar surface texturing.

19. A form liner system comprising:

a first form liner comprising a plurality of raised portions defining a plurality of cells, said raised portions fully surrounding at least one cell, said first form liner comprising at least one first liner partial cell having an edge that is not defined by a raised portion;

a second form liner adjacent to said first form liner; said second form liner comprising at least one raised portion defining a second liner partial cell, said second liner partial cell having an edge that is not defined by a raised portion; and a bridge member;

wherein said first liner partial cell and said second liner partial cell are constructed and arranged to form a collective cell, said bridge member sized to fit in said collective cell, a thickness of said bridge member being less than a height of a raised portion bounding said first liner partial cell.

20. The form liner system of claim 19, wherein said bridge member comprises an adhesive and a removable non-stick backing.

* * * * *